United States Patent [19]

Ostroski et al.

[11] Patent Number: 4,850,076

[45] Date of Patent: Jul. 25, 1989

[54] BRUSH VAC

[75] Inventors: Richard J. Ostroski, Aurora; James E. Bigley, Warren; John L. Falk, Aurora; E. Charles Sallee, Berea, all of Ohio

[73] Assignee: The Scott Fetzer Company, Westlake, Ohio

[21] Appl. No.: 219,836

[22] Filed: Jul. 7, 1988

Related U.S. Application Data

[63] Continuation of Ser. No. 31,524, Mar. 26, 1987, abandoned.

[51] Int. Cl.[4] ..... A47L 9/00

[52] U.S. Cl. ..... 15/328; 15/419

[58] Field of Search ..... 15/320–323, 15/328, 331–336, 419

[56] References Cited

U.S. PATENT DOCUMENTS

| | | | |
|---|---|---|---|
| 1,795,533 | 3/1931 | Wright | 15/328 |
| 1,815,225 | 7/1931 | White | 15/328 |
| 2,355,183 | 8/1944 | Synder | 15/328 |
| 3,942,216 | 3/1976 | Minton | 15/416 |
| 4,447,930 | 5/1984 | Glenn et al. | 15/322 |
| 4,549,328 | 10/1985 | Martin et al. | 15/328 |

*Primary Examiner*—Harvey C. Hornsby
*Assistant Examiner*—Corinne M. Reinckens
*Attorney, Agent, or Firm*—Watts, Hoffmann, Fisher & Heinke

[57] ABSTRACT

A hand-held combination power brush and suction cleaner unit having control means to selectively adjust and shut off suction air flow for brush working a surface without vacuum pick-up and with reserve motor power, the unit being particularly suited for use with dry particle cleaners.

3 Claims, 1 Drawing Sheet

BRUSH VAC

This application is a continuation of application Ser. No. 031,524, filed 3/26/87, abandoned 9/8/88.

BACKGROUND OF THE INVENTION

The invention relates to surface cleaning apparatus and, more particularly, relates to improvements in combination power brush and suction cleaner devices

PRIOR ART

U.S. Pat. No. 4,498,214 to Oxel discloses the use of dry particle cleaners in conjunction with an upright brush and suction cleaner apparatus. U.S. Pat. No. 4,549,328 to Martin et al. discloses a floor nozzle having a shroud which is movable to control suction to the nozzle and allow working of dry powder against a floor surface without application of suction to the nozzle. U.S. Pat. No. 4,462,137 to Berfield et al. illustrates a vacuum cleaner with a suction force control which circulates or shunts air from the fan outlet to the fan inlet.

None of the prior art known to applicant suggests a power brush and suction cleaner with a single motor that offers a simple air flow control system to permit agitation of dry cleaner particles against a surface being cleaned while vacuum air flow is suspended.

SUMMARY OF THE INVENTION

The invention provides a combination power brush and suction cleaner with a single motor positively driving both the brush and the vacuum fan and with a control valve for selectively limiting vacuum air flow during special cleaning operations.

The control valve of the invention is selectively moveable between fully opened and closed positions as well as an intermediate partially opened position. In its fully closed position, the valve permits the brush to work on a surface without vacuum air flow. In this mode, for example, the cleaner can be used with a dry particle cleaner by allowing the brush to rub such material into a rug or upholstery fabric, for instance, before it is ultimately collected by vacuum air flow. In a restricted flow position, the valve allows the cleaner unit to be conveniently used where a light vacuum is advantageous such as in the cleaning of drapes, other loose fabrics or delicate objects.

In the preferred arrangement, the fan and brush are both positively and continuously connected to the motor shaft. Ideally, the fan has reduced power requirements when air flow through it is restricted. Thus, when air flow is shut off by the control valve, in accordance wth the invention, the motor has reserve power available for brushing work. The flow control valve is strategically located downstream of the fan so that it avoids interference with the fan and brush drive. Consequently, the control valve can be of simple construction and operation.

DESCRIPTION OF THE PREFERRED EMBODIMENT

Figure 1:
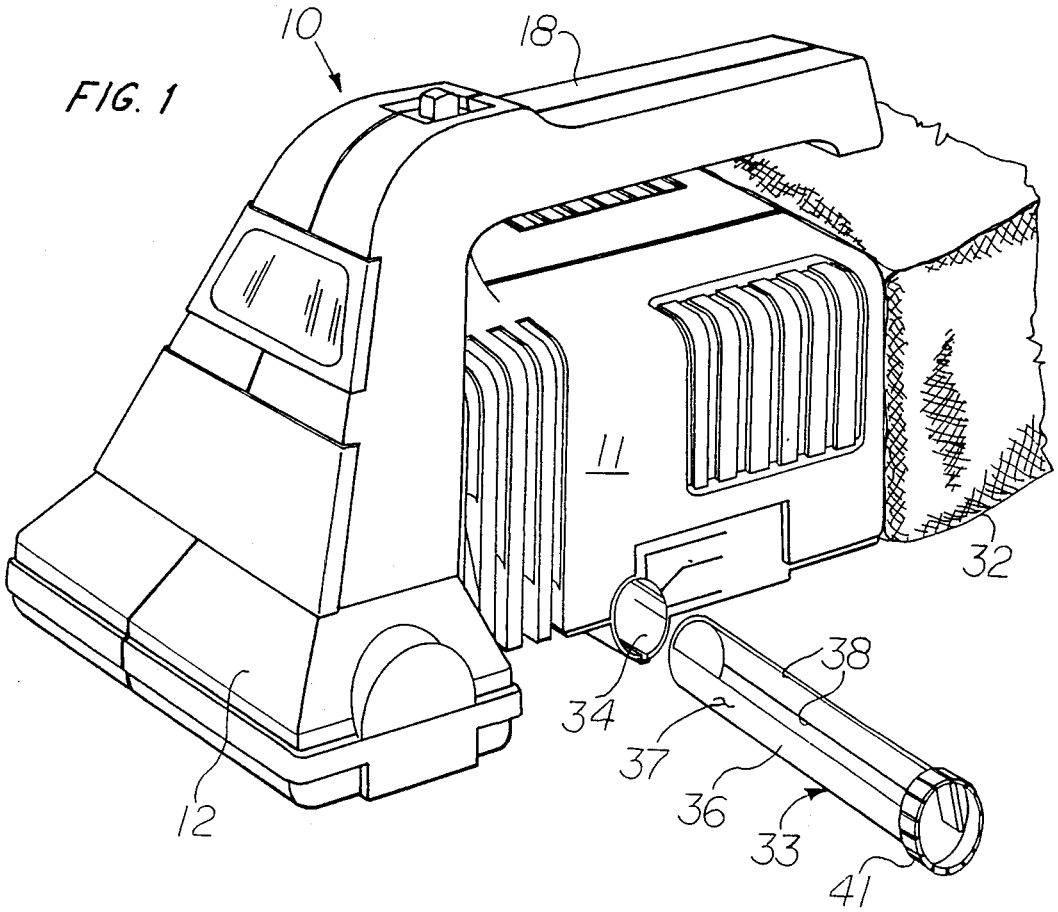
FIG. 1 is a perspective view of a power brush and suction cleaner constructed in accordance wth the invention.
Figure 2:
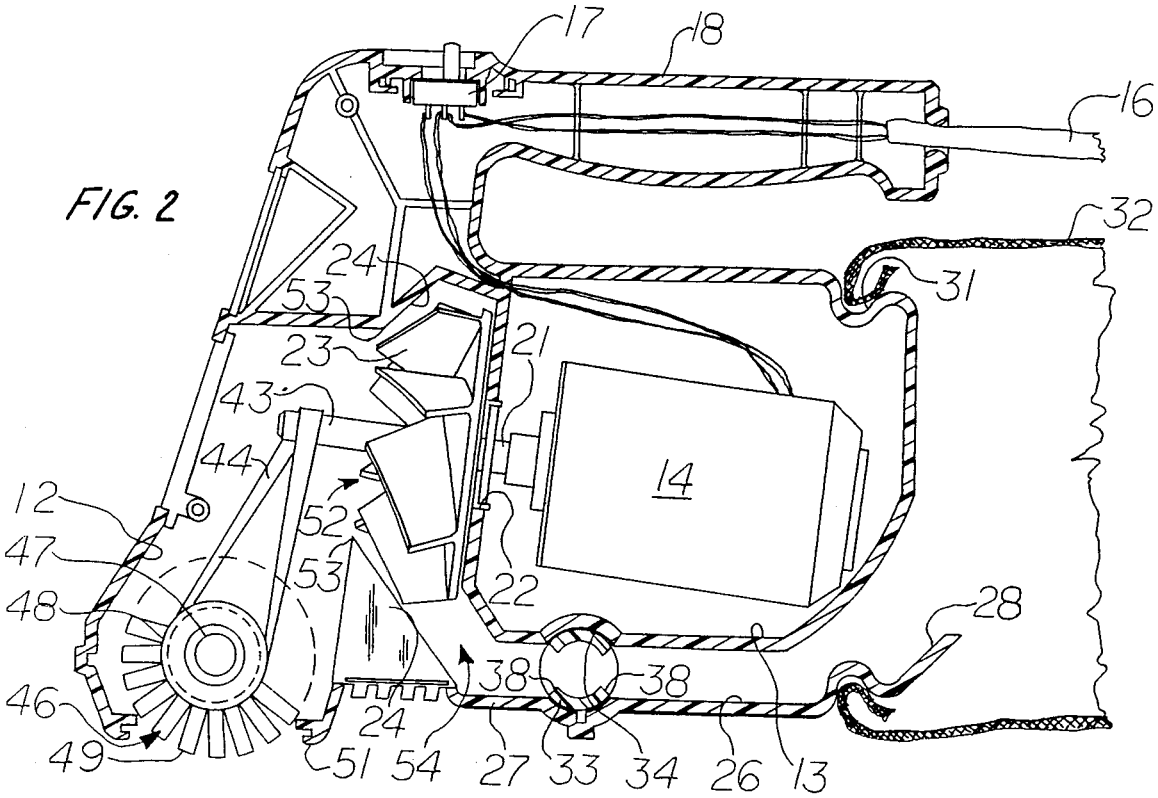
FIG. 2 is a cross-section view, taken in a longitudinal central plane, of the cleaner of FIG. 1.

Referring now to the drawings, there is shown a hand-held combination power brush and vacuum cleaner 10. The cleaner unit 10 includes a housing 11 preferably formed as an assembly of injection molded plastic right and left half sections which mate on a longitudinal plane corresponding to the plane of FIG. 2. The housing 11 has an integral nozzle 12 through which dirt and debris are collected. Rearward of the nozzle 12 and within a chamber 13 integrally formed by the housing 11 is an electric motor 14. In the illustrated case, the motor 14 is an alternating current device powered through a flexible electric cord 16 and an electrical switch 17. The cord 16 is suitably mechanically connected to a handle 18 integral with the housing 11 and extending in cantilever fashion above the motor chamber 13.

The motor 14 has a rotary power output shaft 21 extending forwardly through a sealed opening 22 in the chamber 13. A suction fan 23 is fixed on the shaft 21 and operates in rotation with the shaft in a conical shroud 24 integrally formed by the housing.

A passageway 26 formed in the housing 11 between the motor chamber 13 and a lower wall 27 of the housing conducts air flow from the shroud 24 at a location adjacent the rear periphery of the fan 23 to an exhaust port 28. Along the majority of its length, the passageway 26 has a generally rectangular cross-section in a vertical plane perpendicular to the longitudinal direction of the cleaner (i.e. perpendicular to the plane of FIG. 2). A groove 31 adjacent a rear of the housing 11 extends across the top, sides and bottom of the housing. A filter bag 32 is attached to the housing 11 by contstricting its mouth tightly into the groove 31. The exhaust port 28 discharges air, along with collected dirt and debris, directly into the bag 32.

A suction flow control valve 33 extends substantially fully across the passageway 26. The valve 33 has the form of a rotary cock which is received in a zone of the passageway 26 that is locally increased in section to form a chamber 34 with cylindrical wall sections. The valve 33 has a generally cylindrical hollow body 36 with an outer cylindrical surface 37 which closely fits the wall sections of the chamber 34 and allows rotation of the body within this chamber. The body 36 has a pair of diametrally opposed elongated slots 38. Each slot 38 has a length that extends substantially the full width of the passageway 26 and a width substantially equal to the height of the passageway. The valve 33 is shown in a fully opened position in FIG. 2 wherein the slots 38 are aligned with the passageway 26 thereby allowing fluid flow through the valve body 36 and the passageway. In a position rotated 90° about its axis from the position illustrated in FIG. 2, the valve body 36 is in a fully closed position and its outer cylindrical wall areas 37 completely close off adjacent areas of the passageway 26.

A knob 41 integrally formed on the valve body 36 is exposed on an outside of the housing 11 when the body is fully received in the cylindrical chamber or zone 34. The control valve 33 is selectively, manually rotated by grasping and turning the knob 41.

An end 43 of the motor shaft 21 extends as a cantilever axially forward of the suction fan 23. An endless drive belt 44 is looped over the shaft end 43 and a central region of a rotary brush 46. The belt 44 provides a continuous power drive between the motor 14 and the rotary brush 46. The belt 44 is given a half twist in a known manner to accommodate the right angle or transverse relation of the motor axis and the brush axis. The brush 46 rotates on anti-friction bearings assembled in each of its ends and over a non-rotating central shaft 47 removably retained in the housing nozzle 12. The brush 46 is an assembly of a generally cylindrical body 48 and radial bristles 49 which project from the body 48 outside of a plane of a lower edge 51 of the nozzle 12. The bristles 49 are capable of effectively brushing or working a surface as the nozzle is caused to pass over such surface.

Power operation of the motor 14 is controlled by the switch 17 on the handle 18. With the motor 14 running, both the fan 23 and brush 46 are positively driven, allowing the unit 10 to produce an efficient combination of rotary brush sweeping action and suction air flow pick-up of dust and debris. In rotation, the fan 23 produces a low pressure zone 52 at a central inlet 53 of the shroud 24 through which the motor shaft 21 projects. This low pressure zone 52 induces suction air flow into the nozzle opening formed by the lower nozzle edge 51 and around the brush 46. This air flow, along with entrained dirt and debris, moves through the shroud aperture or inlet 53 and spaces between the blades of the fan 23. Rotation of the fan 23 produces a high pressure zone 54 at its rear, radially outer periphery. When the valve 33 is in the open position, this dirt laden air is propelled by the fan 23 through the passageway 26 at a pressure above atmospheric pressure. Air and dirt is discharged from the passageway exhaust port 28 into the filter bag 32. The dirt is trapped in the bag 32 while air escapes through the porous walls of the bag.

The cleaner unit 10 is particularly useful in situations where brush agitation over a surface being treated is desired without vacuum air flow. An example of such a situation is in the use of dry particle cleaners such as the product marketed under the registered trademark CAPTURE. During such operation, the knob 41 is rotated to close the control valve 33 to a position 90° from that illustrated in FIG. 2, as previously mentioned. In this position, the valve 33 prevents air flow through the passageway 26 and, in turn, through the fan 23 and nozzle 12. The rotary brush 46 can be used to scrub or otherwise work a surface until the desired effect is accomplished. Preferably, the fan or air pump 23 is of a type which when rotated without allowing air to flow through it, at or moderately above normal operating rotational speeds requires less power than when air is allowed to flow freely through it. This characteristic of the fan 23 provides reserve motor power for vigorous brushing action during periods when the control valve 33 is closed. The fan 23 can be, for example, of the general type disclosed in U.S. patent application Ser. No. 539,103, filed Oct. 5, 1983 without a rotating front shroud. In the use of a dry particle or powder cleaner, once a surface has been adequately agitated with the cleaner by the brush 46, the valve 33 is opened to allow vacuum air flow to collect the cleaner particles.

When a moderate suction air flow is desired such as when cleaning curtains or other loose fabrics or special circumstances, the valve 33, by the knob 41, is moved to an intermediate position where the passageway 26 is only partially closed off. This intermediate valve position corresponds, for example, to a position of the valve body 36 rotated 45° from the position illustrated in FIG. 2.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

We claim:

1. A combination brush and suction cleaner comprising a housing having a suction nozzle and an exhaust, an electric motor in the housing with a shaft adjacent the nozzle, a rotary brush journalled for rotation in the nozzle, a drive from the motor shaft to the brush, a fan on the motor shaft having, during motor operation, a zone of low pressure and a zone of high pressure and being adapted to induce air flow from the low pressure zone to the high pressure zone, first passage means connecting the low pressure zone to the nozzle for drawing air into the nozzle and second passage means connecting the high pressure zone to the exhaust, valve means movably disposed in the second passage means for selectively regulating the flow of air induced by the fan and drawn through the nozzle, the valve means being adapted to substantially completely close off fan induced flow through the nozzle to allow the brush to work a surface without application of vacuum air flow on such surface, said valve means including a valve member positionable in a valve receiving chamber forming part of said second passage means in a plurality of positions intermediate a fully opened and a fully closed position whereby said suction force at said nozzle is adjustable from substantially zero to a predetermined maximum, said second passage means defining a substantially cylindrical, valve member receiving chamber including opposed cylindrical wall sections, said valve member comprising a rotary cock having a generally cylindrical hollow body sized to closely fit within said chamber wall sections and defining a pair of slots selectively positionable relative to chamber openings defined by said chamber whereby the rate of air flow in said second passage means is adjusted, said valve member being manually operable by a knob external of said housing.

2. A combination brush and suction cleaner comprising a housing having a suction nozzle and an exhaust, an electric motor in the housing with a shaft adjacent the nozzle, a rotary brush journalled for rotation in the nozzle, a drive from the motor shaft to the brush, a fan on the motor shaft having, during motor operation, a zone of low pressure and a zone of high pressure and being adapted to induce air flow from the low pressure zone to the high pressure zone, first passage means connecting the low pressure zone to the nozzle for drawing air into the nozzle and second passage means connecting the high pressure zone to the exhaust, valve means movably disposed in the second passage means for selectively regulating the flow of air induced by the fan and drawn through the nozzle, the valve means being adapted to substantially completely close off fan induced flow through the nozzle to allow the brush to work a surface without application of vacuum air flow on such surface, said valve means including a valve member positionable in a valve receiving chamber forming part of said second passage means in a plurality of positions intermediate a fully opened and a fully closed position whereby said suction force at said nozzle is adjustable from substantially zero to a predetermined maximum, said valve member being manually operable to a knob external of said housing.

3. a cleaner as set forth in claim 2, wherein said valve member is a rotary cock disposed in said chamber within the housing.

* * * * *